United States Patent [19]

Escales

[11] 4,037,768

[45] July 26, 1977

[54] APPARATUS FOR BRAKING WEBS OF PHOTOGRAPHIC MATERIAL OR THE LIKE

[75] Inventor: Eberhard Escales, Munich, Germany

[73] Assignee: AGFA-Gevaert Aktiengesellschaft, Leverkusen, Germany

[21] Appl. No.: 688,190

[22] Filed: May 20, 1976

[30] Foreign Application Priority Data

May 30, 1975 Germany ..... 2524101

[51] Int. Cl.[2] ..... B65H 25/10

[52] U.S. Cl. ..... 226/43; 226/33

[58] Field of Search ..... 226/2, 27, 33, 43, 134–136

[56] References Cited

U.S. PATENT DOCUMENTS 3,581,964 6/1971 Betron et al. ..... 226/33

*Primary Examiner*—Robert W. Saifer

*Attorney, Agent, or Firm*—Peter K. Kontler; John Kurucz

[57] ABSTRACT

Apparatus for transporting a perforated web of photographic material in stepwise fashion has a variable-speed motor which drives the web, a bundle of light conductors which receive light seriatim when a perforation of the web passes between their ends and a light source whereby the conductors transmit light to associated phototransistors which effect the transmission of different first signals at timely spaced intervals to a comparator amplifier which further receives a continuous signal from a tachometer generator driven by the motor. The amplifier gradually decreases the speed of the motor to zero speed which is reached when the last phototransistor receives light from the respective conductor. The phototransistors are connected with an input of the amplifier by Darlington transistors, flip-flops, additional transistors and a chain of resistors.

13 Claims, 4 Drawing Figures

APPARATUS FOR BRAKING WEBS OF PHOTOGRAPHIC MATERIAL OR THE LIKE

BACKGROUND OF THE INVENTION

The present invention relates to apparatus for intermittently moving webs of photographic material or the like. More particularly, the invention relates to improvements in apparatus for effecting rapid acceleration of a web of photographic material or the like from zero speed to a maximum speed and for thereupon effecting controlled deceleration of the web to zero speed. Such apparatus are needed in photographic copying machines to facilitate subdivision of a web consisting of a row of neighboring prints into discrete prints or to place successive frames of an exposed and developed film into accurate register with the optical system of a printer.

It is already known to advance a web of photographic material or the like by means of a variable-speed motor and to change the speed of the motor in response to detection of markers (e.g., notches or perforations) which are provided in the web. As a rule, the detection of a marker results in deceleration of the motor from a relatively high normal or first speed to a much lower second or creep speed, and the motor is thereupon arrested with a predetermined delay subsequent to deceleration to second speed. Such mode of decelerating the web to zero speed was considered necessary in order to reduce the influence of friction as well as the influence of inertia of moving parts including the web. A drawback of the just described apparatus is that the deceleration of a web from maximum speed to zero speed takes up too much time because each stoppage of the motor is invariably preceded by a certain interval during which the motor is driven at the relatively low and normally constant second speed. Moreover, and in order to insure that the web is invariably arrested in an optimum position (e.g., in a position in which the knife of a severing mechanism can separate two neighboring prints exactly across the center of the frame line between such prints), the second speed must be sufficiently low to enable the motor to come to a full stop with a high degree of reproducibility. Rapid transport of a web between successive stoppages (i.e., the achievement of short intervals between successive stoppages of the web) is highly desirable in modern high-speed machines for the processing of photographic material or the like.

German OS No. 2,246,543 discloses a modified apparatus which is intended to effect rapid deceleration of a web from maximum speed to zero speed. The apparatus comprises means (e.g., a tachometer generator) which furnishes a signal indicating the momentary speed of the motor (and hence the momentary speed of the web) and means for furnishing a signal which indicates the maximum permissable speed of the motor at any given stage of movement of a predetermined point of the web toward that position which the point should occupy when the web is brought to a full stop. This is intended to insure that the motor is operated at a maximum permissible speed during the entire stage of deceleration from maximum speed to zero speed without permitting the aforementioned point of the web to overshoot the intended position. A drawback of the just described apparatus is that the system for indicating the maximum permissible speed of the web during each stage of its deceleration to zero speed is extremely complex and prone to malfunction. The system includes a device which is mechanically coupled to the web and indicates the distance of the predetermined point of the web from the position which the point is to occupy when the web is brought to a full stop. The accuracy of such device is unsatisfactory, i.e., this device constitutes a systematic source of errors whose magnitude depends on the dissolution accuracy of the device, and this contributes to complexity of other parts of the system because they must compensate for inaccuracies of the distance measuring device. Slippage of the web relative to the customary advancing or transporting rolls which receive torque from the variable-speed motor also contributes to errors, especially since such slippage normally occurs during deceleration of the web which, in turn, causes the web to overshoot, or come to a full stop short of, its intended position.

SUMMARY OF THE INVENTION

An object of the invention is to provide a novel and improved apparatus which is capable of repeatedly and rapidly arresting a web of photographic material or the like with a high degree of accuracy and predictability, and whose construction is simpler than that of conventional apparatus.

Another object of the invention is to provide the apparatus with novel and improved means for continuously monitoring the speed of the web and the distance between a given point of the web and the locus where such point is to be positioned when the web is brought to a full stop.

A further object of the invention is to provide an apparatus which can be used to control the movements of webs which are provided with conventional indicia in the form of grooves, notches, perforations or the like.

An additional object of the invention is to provide a novel and improved apparatus which insures that equally spaced portions of a web of photographic material or the like neither overshoot nor come to a full stop short of the locus where such portions must be located during successive stoppages of the web.

Still another object of the invention is to provide an apparatus which can insure controlled deceleration of a rapidly moving web in such a way that the deceleration takes place in any desired number of stages to thus insure that the total time which is needed for deceleration is shorter than in heretofore known apparatus irrespective of the selected maximum speed of the web.

The invention is embodied in an apparatus for repeated rapid acceleration and controlled braking or deceleration of a web of photographic paper, photographic film or the like which is provided with a series (preferably a row) of markers, such as notches, recesses or perforations. The apparatus comprises means (preferably including a variable-speed motor and web-advancing rolls at least one of which receives torque from the motor) for moving the web lengthwise along a predetermined path, a light source which is adjacent to the path for the web, a succession of photosensitive transducers (e.g., phototransistors) positioned to receive light seriatim from the light source in response to movement of a marker past the source and to effect transmission of different first signals which are indicative of decreasing permissible speeds of the motor while such marker occupies those portions of the path in which it effects illumination of successive transducers (these transducers include a first transducer and a last transducer), and means for changing the speed of the motor in response to the first signals. Such speedchanging means includes means (e.g., a tachometer generator) for furnishing a second signal which is indicative of the actual or momentary speed of the motor and means (e.g., a comparator amplifier for comparing the second signal with first signals which are transmitted in response to illumination of successive transducers and for changing the speed of the motor in response to transmission of successive first signals thereto so that the speed of the motor decreases from the speed indicated by the second signal to the speed indicated by a first signal not later than when the next-following transducer of the succession of transducers effects the transmission of a first signal. The first signal which is transmitted in response to illumination of the last transducer is indicative of zero speed.

The intensity of first signals is indicative of the distance which the web is to cover prior to stoppage when the respective transducers receive light, as well as of the desired optimum speed of the web at that particular stage of movement. As mentioned above, the last transducer of the series will effect the transmission of a first signal which is indicative of zero speed so that the web comes to a halt when the first signal which is produced in response to illumination the last transducer reaches the signal comparing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a partly perspective and partly diagrammatic view of an apparatus which embodies the invention;

DESCRIPTION OF THE PREFERRED EMBODIMENTS

Figures 2, 3A, 3B:
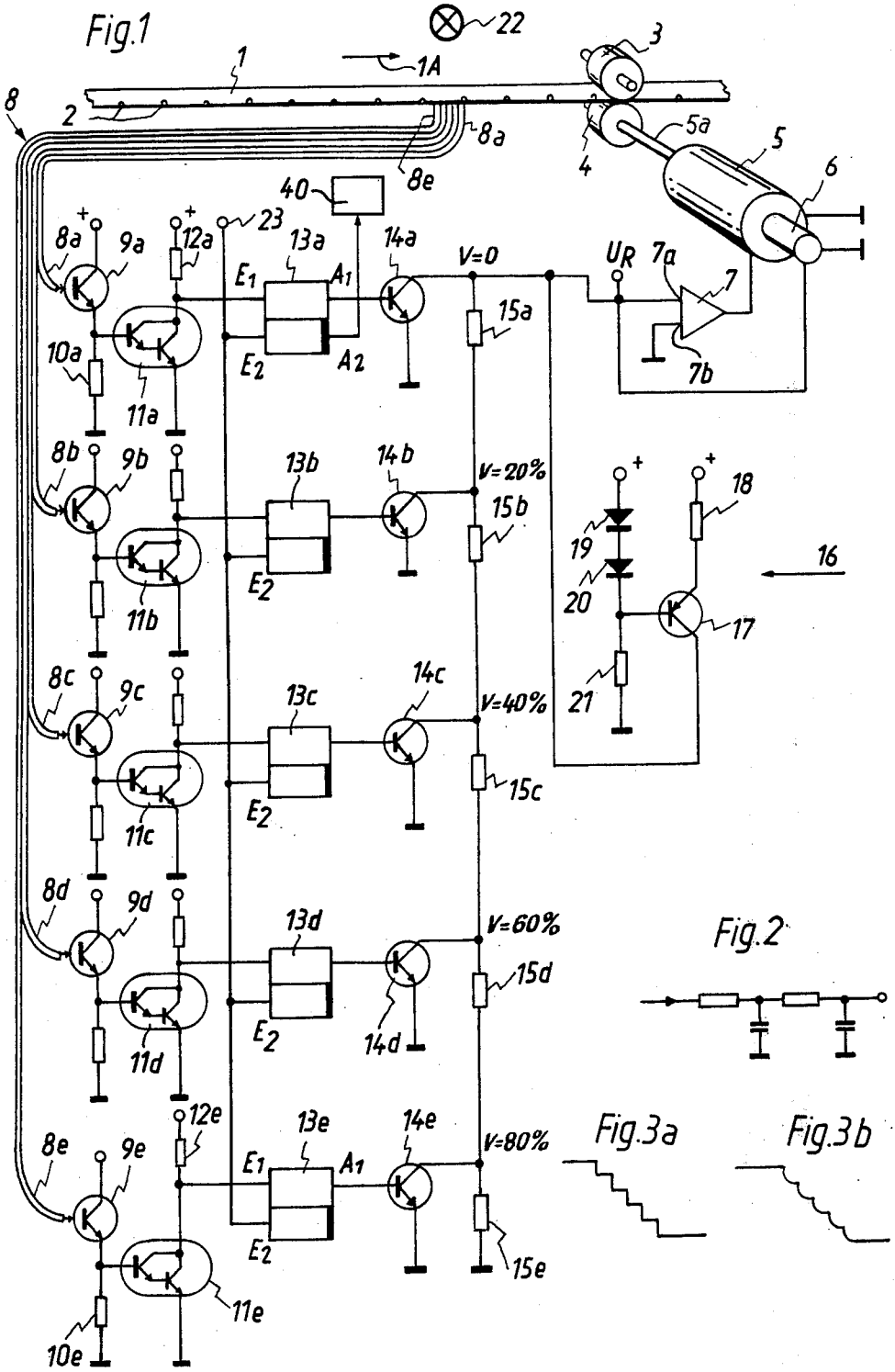
FIG. 2 is a diagram of a circuit which can be utilized in the apparatus of FIG. 1.
FIG. 3*a* is a curve representing the reduction of motor speed in the absence if the circuit which is shown in FIG. 2.
FIG. 3*b* is a curve representing the reduction of motor speed when the apparatus embodies the circuit of FIG. 2.

Referring first to FIG. 1, there is shown an elongated web 1 of flexible sheet material, e.g., a web of photographic paper bearing images of photographic negatives and about to be subdivided into discrete prints. Each frame of the web is identified by a marker or index 2, e.g., a notch or perforation in one marginal portion of the web. The purpose of markers 2 is to enable the apparatus to arrest the web 1 in successive positions in each of which the foremost frame of the web can be separated from the next-following frame by severing the web exactly midway across the frame line between such frames. Alternatively, the web 1 may constitute a strip of photographic film which has been exposed and developed and is to be moved through a copying or printing machine so that successive frames of the film are located in exact register with the optical system of the copying or printing machine.

The means for moving the web 1 along a predetermined path and in a direction to the right, as viewed in FIG. 1, comprises two advancing rolls 3, 4 the latter of which is mounted directly on the output shaft 5*a* of a variable-speed motor 5 and the former of which is preferably biased toward the roll 4 in a manner not specifically shown in the drawing. Whenever the motor 5 is started, the rolls 3, 4 are caused to rotate and to advance the web 1 through a predetermined distance. If desired or necessary, the output shaft 5*a* of the motor 5 can drive the roll 4 through the medium of a step-up or step-down transmission, not shown.

The motor 5 is a DC-motor, preferably a moving coil motor and most preferably a disc armature motor or a shell armature motor whose output shaft 5*a* carries and transmits torque to a tachometer generator 6 constituting a means for producing a signal which is indicative of the momentary or actual speed of the motor.

The path of movement of the row of markers 2 is located below a light source 22 which is disposed at a level above the upper ends of five closely adjacent light conductors 8*a*, 8*b*, 8*c*, 8*d*, 8*e* which form a bundle 8. The upper ends of the light conductors 8*a*–8*e* form a row which is parallel to the roll of markers 2 so that the upper end of a light conductor receives light when a marker 2 is located between such upper end and the beam of light issuing from the source 22.

The lower ends of the light conductors 8*a*–8*e* respectively transmit light beams to photosensitive transducers here shown as phototransistors 9*a*, 9*b*, 9*c*, 9*d* and 9*e*. the number of photosensitive transducers can be increased above or reduced below five, depending upon the desired number of stages of deceleration of the motor 5 before the speed of the advancing rolls 3, 4 is reduced from maximum speed to zero speed. The number of photosensitive transducers also depends on the maximum speed of the motor 5 as well as on the length of the interval and the distance which is available to reduce the speed of the web 1 from maximum speed to zero speed. Still further, the number of stages depends on the desired extent of reproducibility of stepwise advances of the web 1, i.e., on the permissible missible extent of deviation of the position of web 1 when the rolls 3, 4 are at a standstill from an optimum position. As mentioned above, if the web 1 is a strip of photographic paper which is to be divided into discrete prints, it is desirable to sever the web exactly across the centers of frame lines between neighboring prints.

It is further within the purview of the invention to omit the light conductors 8*a* to 8*e* and to mount the photosensitive transducers 9*a*–9*e* directly below the path of movement of the markers 2. However, the dimensions of presently available satisfactory photosensitive transducers are such they they cannot be placed sufficiently close together (especially if the apparatus is to reduce the speed of the web 1 in a large number of stages and if the increments through which the web is to be advanced in response to each starting of the motor 5 are relatively short); therefore, it is often desirable to utilize relatively thin light conductors whose light-receiving ends can be placed very close to each other.

The lower ends of the light conductors 8*a*–8*e* are positioned to direct light against the light-sensitive bases of the respective photosensitive transducers 9*a*–9*e*. the collector of the transducer 9*a* is connected to the positive pole of any energy source, and the emitter of the transducer 9*a* is connected with the ground through the medium of a resistor 10*a*. The emitter of the transducer 9*a* is further connected with the base of a Darlington transistor 11*a*. The output emitter of the Darlington transistor 11a is connected with the ground, and the collector of transistor 11a is connected with the positive pole of an energy source by way of a resistor 12a. The collector of transistor 11a is further connected to a first input $E_1$ of a flip-flop 13a. A second input $E_2$ of the flip-flop 13a is connected with a resetting terminal 23, and the output $A_1$ of the flip-flop 13a is connected with the base of a further transistor 14a. The emitter of the transistor 14a is connected to the ground, and the collector of the transistor 14a is connected with one end of a resistor chain 15a, 15b, 15c, 15d, 15e. The other end of the chain 15a–15e is grounded. The collector of the transistor 14a is further connected with a source 16 of constant current including a transistor 17, a resistor 18, diodes 19, 20 and an additional resistor 21. Still further, the collector of the transistor 14a is connected to the input 7a of a comparator amplifier 7 the other input 7b of which is connected to the ground. The input 7a of the amplifier 7 is further connected with the output of the tachometer generator 6. The output of the amplifier 7 is connected with the motor 5, either directly or through the medium of a further amplifier, not shown.

The circuits including the photosensitive transducers 9b–9e are analogous to the circuit of the transducer 9a. Thus, the circuit of the transducer 9b further includes a Darlington transistor 11b, a flip-flop 13b and an additional transistor 14b whose collector is connected to the resistor chain 15a–15e between the resistors 15a, 15b. The collector of the transistor 14c in the circuit of transducer 9c, transistor 11c and flip-flop 13c is connected to the resistor chain 15a–15e between the resistors 15b, 15c, the collector of the transistor 14d in the circuit of transducer 9d, transistor 11d and flip-flop 13d is connected between the resistors 15c, 15d, and the collector of the transistor 14e in the circuit of transducer 9e, transistor 11e and flip-flop 13e is connected between the resistors 15d, 15e.

The operation is as follows:

It is assumed that the motor 5 is on and drives the roll 4 at a maximum speed. The rolls 3, 4 advance the web 1 lengthwise in the direction indicated by arrow 1A. When a marker 2 reaches the upper end of the first or foremost light conductor 8e, the latter receives light from the source 22 and transmits light to the base of the first transducer 9e which becomes conductive and applies voltage to the base of the Darlington transistor 11e. The latter becomes conductive and connects the input $E_1$ of the flip-flop 13e to the ground. The flip-flop 13e is constructed in such a way that, when its input $E_1$ is grounded, the output $A_1$ assumes the condition L and renders the transistor 14e conductive, i.e., the junction between the collector of the transistor 14e and the resistors 15d, 15e of the chain 15a–15e is connected to the ground via transistor 14e.

As stated above, the web 1 is advanced at a maximum speed before a marker 2 reaches the upper end of the foremost light conductor 8e. The transducers 9a–9e are then in a non-conductive state, together with the transistors 14a–14e so that a maximum voltage $U_{max}$ is applied to the terminal $U_R$ and hence to the input 7a of the amplifier 7. The input 7a is further connected with the output of the tachometer generator 6. The amplifier 7 compares the two signals and controls the speed of the motor 5 accordingly. The maximum voltage $U_{max}$ is the product of current supplied by the source 16 and the sum of resistances of resistors 15a–15e.

When a marker 2 allows light to pass from the source 22 to the base of the photosensitive transducer 9e so as to render the transistor 14e conductive, the combined resistance of the resistor chain 15a–15e is reduced by the resistance of the resistor 15e because the resistor 15d is connected to the ground via transducer 14e. The voltage at the terminal $U_R$ is reduced by a predetermined value so that it equals the product of current supplied by the source 16 and the combined resistance of resistors 15a–15d. The speed of the motor 5 decreases, e.g., to 80 percent of the maximum speed.

The marker 2 which has permitted light to reach the base of the first transducer 9e thereupon moves between the light source 22 and the upper end of the light conductor 8d to render the transducer 9d conductive whereby the transistor 14d connects the resistor 15c to the ground and the voltage at the terminal $U_R$ is reduced to the product of current supplied by 16 and the sum of resistors 15a–15c. The speed of the motor 5 decreases again, e.g., to 60 percent of its maximum speed.

As the marker 2 which has admitted light to the conductor 8d reaches the upper ends of the next-following conductors 8c, 8b and 8a, the transistors 14c, 14b, 14a becomes conductive and respectively connect the ground with the resistors 15b, 15a and the input 7a of the amplifier 7 whereby the speed of the motor 5 respectively decreases to 40, 20 and zero percent of maximum speed.

Since the speed of the motor 5 is regulated directly by the markers 2 of the web 1, the position of the web 1 when the motor 5 is idle can be determined with a high degree of accuracy and reproducibility, i.e., with the same degree as the positions of markers 2 on the web 1.

The flip-flop 13a has a second output A2 which transmits a signal when the terminal $U_R$ is connected to the ground via transistor 14a. Such signal can be produced with a certain delay (or can be delayed by a suitable time-delay device, not shown) so as to actuate the means 40 for servering the web 1 after the motor 5 has been brought to a full stop, i.e., while the forward speed of the web 1 is zero. The severing means 40 is located downstream of the advancing rolls 3, 4.

When the severing and/or another web-treating operation is completed, the severing device (or another component of the machine which embodies the improved apparatus) transmits a signal to the terminal 23 which is connected with the inputs E2 of the flip-flops 13a–13e. The signals to the inputs E2 causes the signals at the respective inputs E1 to disappear so that signals at the outputs A1 of the flip-flops 13a–13e also disappear and the transistors 14a–14e become non-conductive. The voltage signal at the terminal $U_R$ again equals $U_{max}$ and such signal is compared with the signal from the tachometer generator 6 (while the motor 5 is at a standstill). The result is a strong imbalance of the amplifier 7 and rapid acceleration of the motor 5 to maximum speed. The acceleration is constant, i.e., the velocity curve of the motor 5 and web 1 during acceleration is a substantially straight line. The deceleration of the motor 5 from maximum speed begins again as soon as the next-following marker 2 moves between the light source 22 and the upper end of the foremost light conductor 8e.

If the resistances of resistors 15a–15e are identical, the speed of the motor 5 can be reduced to zero speed by identical increments. As mentioned above, and assuming that the apparatus employs a chain of five identical resistors 15a–15e, the motor speed can be reduced stepwise from 100 to 80, 60, 40, 20 and 0 percent of maximum speed.

In accordance with a modification, the terminal $U_R$ can be connected with the first input 7*a* of the amplifier 7 by means of a filter circuit of the combination resistor-capacitor type shown in FIG. 2. The purpose of this circuit is to prevent abrupt stepwise reduction of the motor speed in response to grounding of successive resistors 15*d*, 15*c*, 15*b*, 15*a*. Thus, whereas the speed of the motor 5 decreases in a manner as shown by the curve of FIG. 3*a* (this curve also represents the stepwise reduction of voltage at the terminal $U_R$) if the filter circuit of FIG. 2 is omitted, the presence of this circuit renders it possible to achieve a deceleration curve of the type shown in FIG. 3*b*. An advantage of the filter circuit of FIG. 2 is that the braking action upon the motor 5 is smoother, i.e., without a strongly pronounced transition from a higher to the next lower speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for repeated rapid acceleration and controlled braking of a web which is provided with a series of markers, such as notches, or perforations, comprising means for moving the web lengthwise along a predetermined path, including a variable-speed motor; a light source adjacent to said path; a succession of photosensitive transducers positioned to receive light seriatim from said source in response to movement of a marker past said source and to effect transmission of different first signals which are indicative of decreasing permissible speeds of said motor while such marker occupies those portions of said path in which it brings about illumination of successive transducers, said transducers including a first transducer and a last transducer; means for changing the speed of said motor in response to said first signals, including means for furnishing a second signal which is indicative of the actual speed of said motor and means for comparing said second signal with first signals whose transmission is effected by successive transducers and for changing the speed of said motor in response to transmission of successive first signals thereto so that the speed of said motor decreases from the speed indicated by said second signal to the speed indicated by a first signal not later than when the next-following transducer of said succession effects the transmission of a first signal, the first signal whose transmission is effected by said last transducer being indicative of zero speed; and a chain of series-connected resistors in circuit with said transducers, one for each of said transducers said chain having a terminal for transmission of first signals to said signal comparing means.

2. Apparatus as defined in claim 1, wherein said signals are voltage signals and said signal comparing means includes an amplifier.

3. Apparatus as defined in claim 1, further comprising a filter circuit connected between said terminal and said signal comparing means for gradually reducing the intensity of successive first signals which are transmitted to said signal comparing means.

4. Apparatus as defined in claim 3, wherein said circuit is a combination resistor-capacitor circuit.

5. Apparatus as defined in claim 1, further comprising a constant energy source connected with said terminal, said chain having a second terminal which is connected to the ground and said circuit further comprising means for changing the voltage at said first terminal from a maximum value to zero in response to illumination of successive transducers.

6. Apparatus as defined in claim 5, wherein said voltage changing means comprises flip-flops, one for each said transducers and an output connected with said chain.

7. Apparatus as defined in claim 6, wherein said circuit further comprises a transistor for each of said flip-flops, each of said transistors having a base connected to the output of the respective flip-flop and a collector, the collector of the transistor which is associated with said last transducer being connected with said first terminal and the collectors of the other transistors being connected with said chain between different pairs of resistors, the emitters of said transistors being grounded.

8. Apparatus as defined in claim 6, further comprising means for treating the web during intervals of idleness of said motor, the flip-flop which is associated with said last transducer having a second output arranged to transmit a signal for actuation of said treating means in response to illumination of said last transducer.

9. Apparatus as defined in claim 1, further comprising discrete light conductors for conveying light to said transducers, said conductors having light-receiving ends adjacent to said path.

10. Apparatus as defined in claim 1, wherein each of said transducers includes a phototransistor.

11. Apparatus as defined in claim 1, wherein said motor is a moving coil motor having a rotary output element and said means for furnishing said second signal comprises a tachometer generator driven by said output element.

12. Apparatus as defined in claim 11, wherein said motor is a disc armature motor.

13. Apparatus as defined in claim 11, wherein said motor is a shell armature motor.

* * * * *

UNITED STATES PATENT OFFICE

CERTIFICATE OF CORRECTION

Patent No. 4,037,768 Dated July 26, 1977

Inventor(s) Eberhard ESCALES

It is certified that error appears in the above-identified patent and that said Letters Patent are hereby corrected as shown below:

Claim 6, line 3, --and each having an input connected with the respective transducer-- should be inserted after "transducer".

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*